US011309647B2

(12) United States Patent
Benzin

(10) Patent No.: US 11,309,647 B2
(45) Date of Patent: Apr. 19, 2022

(54) PRINTED CIRCUIT BOARD PLUG-IN CONNECTOR COMPRISING A SHIELDING CONNECTION ELEMENT

(71) Applicant: HARTING ELECTRIC GMBH & CO. KG, Espelkamp (DE)

(72) Inventor: Marian Benzin, Hille (DE)

(73) Assignee: Harting Electric GmbH & Co. KG, Espelkamp (DE)

( * ) Notice: Subject to any disclaimer, the term of this patent is extended or adjusted under 35 U.S.C. 154(b) by 0 days.

(21) Appl. No.: 16/970,889

(22) PCT Filed: Feb. 15, 2019

(86) PCT No.: PCT/DE2019/100146
§ 371 (c)(1),
(2) Date: Aug. 18, 2020

(87) PCT Pub. No.: WO2019/158162
PCT Pub. Date: Aug. 22, 2019

(65) Prior Publication Data

US 2020/0395695 A1 Dec. 17, 2020

(30) Foreign Application Priority Data

Feb. 19, 2018 (DE) ..... 10 2018 103 639.6

(51) Int. Cl.
*H01R 4/66* (2006.01)
*H01R 12/72* (2011.01)
(Continued)

(52) U.S. Cl.
CPC ..... *H01R 12/724* (2013.01); *H01R 13/6585* (2013.01); *H01R 13/6595* (2013.01)

(58) Field of Classification Search
CPC ..... H01R 12/722; H01R 12/724; H01R 13/6585; H01R 13/6595
(Continued)

(56) References Cited

U.S. PATENT DOCUMENTS 4,637,669 A 1/1987 Tajima
7,168,987 B1 1/2007 Morohoshi et al.
(Continued)

FOREIGN PATENT DOCUMENTS

DE 103 47 306 B4 10/2005
DE 10 2010 051 954 B3 2/2012
(Continued)

OTHER PUBLICATIONS

European Patent Office, International Search Report and Written Opinion for international application No. PCT/DE2019/100146, dated Apr. 12, 2019, 11 pages (with English translation of International Search Report).
(Continued)

*Primary Examiner* — Khiem M Nguyen
(74) *Attorney, Agent, or Firm* — Seed IP Law Group LLP

(57) ABSTRACT

A printed circuit board plug-in connector is provided comprising a connector installation housing, an insulating body and a shielding connection element, for the shielding connection of a plug-in connector installation housing to a printed circuit board. The shielding connection element is flat or has at least one flat deformation section which is arranged, in the plug-in direction, in a through-slit of an insulating body mounted on the printed circuit board, and protrudes out of the insulating body with two contact regions in order to electrically contact the metal plug-in connector installation housing.

13 Claims, 6 Drawing Sheets

(51) Int. Cl.
*H01R 13/6585* (2011.01)
*H01R 13/6595* (2011.01)

(58) Field of Classification Search
USPC ..... 439/79, 108
See application file for complete search history.

(56) References Cited

U.S. PATENT DOCUMENTS

| | | | |
|---|---|---|---|
| 2013/0045388 | A1 | 2/2013 | Thenhaus |
| 2014/0113490 | A1 | 4/2014 | Simmel et al. |
| 2014/0141634 | A1 | 5/2014 | Sasano et al. |
| 2018/0013240 | A1 | 1/2018 | Takeuchi |

FOREIGN PATENT DOCUMENTS

| | | | |
|---|---|---|---|
| DE | 10 2011 052 792 | A1 | 2/2013 |
| DE | 10 2012 105 256 | A1 | 12/2013 |
| DE | 20 2015 100 245 | U1 | 3/2016 |
| EP | 0 208 143 | A1 | 1/1987 |
| FR | 2 921 522 | A1 | 3/2009 |
| JP | 2015-56299 | A | 3/2015 |
| WO | 2017/133224 | A1 | 8/2017 |

OTHER PUBLICATIONS

German Patent Office, Office Action for German application No. 10 2018 103 639.6, dated Oct. 23, 2018, 6 pages.
International Preliminary Report on Patentability, dated Apr. 12, 2019, for International Application No. PCT/DE2019/100146, 6 pages.

PRINTED CIRCUIT BOARD PLUG-IN CONNECTOR COMPRISING A SHIELDING CONNECTION ELEMENT

BACKGROUND

Technical Field

This disclosure relates to a printed circuit board plug connector having a shield connection element.

Description of the Related Art

Printed circuit board plug connectors are required in device connection technology. They are usually soldered on the connection side to a printed circuit board that is arranged in a housing of an electrical device, in other words in a device housing. An associated electrically conductive plug connector installation housing may be installed in a housing wall of the device housing. In the assembled state of the device, the insulating body of the printed circuit board plug connector protrudes with its plug-in region into the plug connector installation housing but in order to ensure a mechanical tolerance compensation which the construction of the device requires between the printed circuit board and the housing wall said insulating body is not fixed to the plug connector installation housing. However, owing to grounding and shielding requirements, it is necessary to provide a reliable electrically conductive ground connection between the plug connector installation housing and the printed circuit board. This may be produced for example by means of a shield connection element.

The publication DE 10 2010 051 954 B3 discloses a round plug connector that is provided with its connection side so as to make contact on printed circuit boards. So as to provide crosstalk attenuation, an electrically conductive and conductive shield cross that is connected to a ground connection of the printed circuit board is provided. The shield cross is surrounded by a likewise cross-shaped contact carrier and receiving grooves for holding the electrical contacts are provided in its inclined inner edges. The electrically non-conductive round body that is ultimately in turn surrounded by an electrically conductive plug connector installation housing is pushed over this cross-shaped arrangement.

Said publication further discloses that the insulating round body comprises approximately in the middle with regard to its length a circumferential groove into which a shield spring is inserted, wherein the shield spring that may be configured in particular as a helical spring makes contact by means of slits provided in the rounded body on the one hand with the electrically conductive shield cross and on the other hand with the plug connector installation housing that surrounds the round body and is electrically shielding. This plug connector installation housing may be installed in the form of a front plate insert into an electrically conductive device housing and may be connected to a mating connector that is inserted from outside.

The publication DE 10 2012 105 256 A1 discloses a comparable printed circuit board plug connector. In this case, a spring washer is illustrated that obviously has a suitable contour in order to make electrical contact on the one hand with the shield cross and on the other hand with a plug connector installation housing in which the insulating body is inserted.

Furthermore the publication DE 103 47 306 B4 discloses a shield connection between a printed circuit board, which receives electrical and/or electronic components and is arranged in a housing, and at least one connection socket that is arranged in a wall of the housing and comprises a metal cylindrical socket casing. The shield connection is configured from a metal, annular shield connection element, which comprises in each case away from the annular plane, contact pins that protrude on the one annular face for the mechanical and electrical connection with the circuit board and spring limbs that protrude on the other annular face so as to contact the socket casing. The socket casing of the plug connector installation housing is inserted between these contact pins in a coaxial manner with respect to the shield connection element.

Finally, the publication WO 2017/133224 A1 discloses a shield element for a plug connector that contacts a plug connector installation housing in a conductive manner. In particular, said shield element may be a stamped-bent metal part. The shield element is configured in the shape of a ribbon and arranged in order to extend at least in part around a wall of the plug connector that extends in the plug-in direction.

This shield element has one or multiple tabs that protrude at an acute angle therefrom inward and outward in order thereby to electrically contact the plug connector installation housing, to electrically contact a shield cross that is arranged in an insulating body and/or to fix the shield element on the insulating body. Furthermore, the shield element comprises a printed circuit board connection element for connecting to a ground contact of a printed circuit board.

This construction renders it possible to fundamentally enlarge the tolerance region mentioned in the introduction between the printed circuit board and the corresponding device housing wall. A disadvantage of the tabs used in this case may be regarded as being that said tabs only press against the plug connector installation housing with a comparatively small magnitude of force. It is also possible over a long period of time in the case of this construction depending upon the materials used for a slight deformation of the material of the shield element to occur which further reduces the pressing force and thus the electrical conductivity of this contact.

It is a constant requirement in the prior art to provide a shield connection that is as reliable as possible and especially conductive with regard to the electrical supply and that in addition renders possible a mechanical tolerance region that is as large as possible between the device housing and a printed circuit board that is arranged therein. Furthermore, it has proven to be disadvantageous when assembling the device that particularly strong forces and the associated corresponding mechanical stresses act on the printed circuit board if a multiplicity of insulating bodies that are attached thereto are simultaneously inserted into the respective plug connector installation housing.

During the priority application regarding the current application, the German Patent and Trademark Office has researched the following prior art:

DE 20 2015 100 245 U1, JP 2015-56299 A, US 2014/0141634 A1, U.S. Pat. No. 7,168,987 B1, US 2014/0113490 A1 and US 2018/0013240 A1.

BRIEF SUMMARY

A shield connection element is provided that ensures a particularly reliable and especially electrically conductive ground connection over a large as possible and particularly simple to define geometric tolerance region.

A printed circuit board plug connector is also provided which comprises such a shield connection element.

The shield connection element is used to electrically contact a plug connector installation housing to a ground connection of a printed circuit board by way of a mechanical interaction between the shield connection element and an insulating body of the printed circuit board plug connector.

The shield connection element comprises at least one planar deformation section.

Furthermore, the printed circuit board plug connector comprises a plug connector installation housing that is embodied at least in part from metal.

In addition, the printed circuit board plug connector has an insulating body that comprises a through-going slit into which the shield connection element is inserted.

The insulating body is arranged with its plug-in region in the plug connector installation housing and, in order for the plug connector installation housing to electrically contact the ground connection of the printed circuit board, the plug connection element electrically contacts with its contact sections, which protrude on both sides radially out of the insulating body, the plug connector installation housing from inside at two sites that lie opposite one another.

Advantageously, the deformation section is used so as to mechanically and electrically contact the plug connector installation housing that is advantageously electrically conductive and preferably is embodied at least in part from metal. For this purpose, the deformation section may elastically deform in the plane of its deformation section, referred to below as deformation plane, whilst applying a corresponding restoring force and thus press against the plug connector installation housing with a contact force that corresponds to the restoring force in order to render possible the electrical contact with a corresponding conductivity value. In particular, the deformation section may press against the plug connector installation housing with at least one preferably two contact regions that are part of the deformation section.

In particular, the shield connection element may be stamped out of an in particular spring-elastic sheet metal. It is particularly advantageous in this case that in particular the deformation section may then by virtue of the associated stamped shape be particularly simply adapted in its corresponding elasticity and also in the contour of its contact regions to meet the respective requirements that are placed on the printed circuit board plug connector and that are further explained in detail below.

The shield connection element may be in particular a stamped-bent part.

Advantageously, the shield connection element may be configured in one piece and is as a consequence may be very simple and cost-effective to manufacture. The shield connection element is advantageously formed from an electrically conductive and preferably spring-elastic material and has at least the said just mentioned deformation section. In particular, the entire shield connection element may have a planar shape.

In this case, the planar shape at least of the deformation section is particularly advantageous since the shield connection element, if it is for example received in an insulating body, may be oriented fully or at least with the planar deformation section in the plug-in direction. Advantageously, the shield connection element may then protrude with its at least one contact region, and preferably two contact regions, out of the insulating body.

As a consequence, during the procedure of inserting the insulating body into a plug connector installation housing, the deformation section of the shield connection element may elastically deform in the deformation plane and thus, whilst applying the desired restoring force as contact force by way of the contour of its contact regions that may be particularly simply adapted, for example using stamping technology, may particularly advantageously mechanically and electrically contact the plug connector installation housing without in so doing tilting. By virtue of the spring-elastic material and its shape which is simple to determine, the shield connection element may as a result of its elastic deformation that occurs in the deformation plane press in a resilient manner in particular with its contact regions against the plug connector installation housing with the desired contact force and thus electrically contact it with the desired high conductivity value.

Advantageously, the shield connection element may be formed from an in particular spring-elastic sheet metal, in particular stamped out. The deformation plane then corresponds to the sheet metal plane, in other words an elastic deformation advantageously occurs in the plane of the sheet metal—and not, as is usual in the prior art, at an angle in particular at a right angle thereto.

If the entire shield connection element is configured in a planar manner, it is particularly cost effective to manufacture because the costly manufacturing step of bending the sheet metal is omitted.

However, in individual advantageous embodiments, the shield connection element may be curved or angled, in particular bent, in some regions that are not part of the deformation section.

The deformation section may by way of example have spring arms on which advantageous contact sections are formed.

It is possible to consider as a region that is not part of the deformation section by way of example a ground contact pin that is used to contact the ground contact of the printed circuit board. This ground contact pin is advantageous because in this manner the plug connector installation housing may be electrically conductively connected to the ground of the printed circuit board, in other words connected to the ground of the printed circuit board.

The shield connection element may cooperate with the insulating body in a particularly advantageous manner in particular in that by way of example it engages with its planar deformation section, in particular with its at least one contact region, at least in regions through a corresponding through-going slit in the insulating body.

It is preferred that the shield connection element comprises two contact regions that are arranged in particular opposite one another.

Also disclosed hereby are at least one, at least two, at least three, at least four, at least five, at least six, . . . at least n contact regions and in particular precisely, two, precisely three, precisely four, precisely five, precisely six, . . . precisely n contact regions, wherein n represents any natural number >0.

Advantageously, the planar shield connection or at least the planar deformation section of the shield connection element lies in a plane, namely the deformation plane, which in the installed state advantageously corresponds with the slit plane of the through-going slit. Advantageously, this slit plane is oriented in the plug-in direction of the insulating body.

The shield connection element is able to generate a mechanical contact force that is required for electrically contacting the plug connector installation housing and is in the form of a counter force to an elastic deformation, wherein this deformation occurs in the said deformation plane.

In other words, the shield connection element generates the required contact force by way of an elastic deformation that occurs in the deformation plane, wherein the entire shield connection element, or at least its planar deformation section in which this elastic deformation possibly occurs, lies in the deformation plane.

Consequently, the shield connection element is able to generate a mechanical contact force that is required for electrically contacting the plug connector installation housing by way of an elastic deformation that occurs in the said deformation plane.

The shield connection element may comprise at least one preferably multiple in particular two contact sections. By way of example, in the assembled state, the contact sections may protrude in each case with one contact region that is part of the respective contact section out of the insulating body in order to mechanically and electrically contact the plug connector installation housing and thereby in particular within a predetermined tolerance range to spring in a movable, electrically contacting manner against an inner region of the plug connector installation housing.

In particular, the shield connection element may have two contact regions that face in opposite directions with respect to one another, wherein the two associated contact sections are arranged in the deformation plane. As a consequence, the plug connector installation housing may be electrically contacted by the shield connection element at two opposite-lying sites. By virtue of its planar shape, the shield connection element may apply between these sites a simply definable and if desired also a fundamentally greater contacting force than the force that is known in the prior art and applied by functional comparable shield element/shield connection elements.

Furthermore, the printed circuit board plug connector may be a round plug connector that is characterized by virtue of the face that its insulating body is fundamentally cylindrical. The through-going slit may then extend at least with its planar slit section in the radial direction toward the cylindrical insulating body. The shield connection element may then be arranged at least with its planar deformation section at least with a part thereof in the through-going slit or at least in the planar slit section of the through-going slit. The shield connection element may engage in this manner through the insulating body. The contact sections of the shield connection element may protrude with their contact regions, in particular in the radial direction, out of the insulating body in order to electrically contact the plug connector installation housing. The slit plane of the insulating body and the deformation plane of the shield connection element are oriented parallel to the plug-in axis of the printed circuit board plug connector.

The through-going slit of the insulating body may correspond at least in part to the shape of the shield connection element in order to receive said shield connection element at least in one direction at least in part in a positive-locking manner. For this purpose, the through-going slit of the insulating body may be configured in a planar manner or may comprise at least the said planar slit section. In the case of a cylindrical insulating body, this through-going slit or at least its planar slit section may be oriented in a radial manner with respect to the insulating body. The shield connection element that is inserted therein may then extend at least deformation section-by-deformation section, in particular with its planar deformation section, in a radial manner with respect to the insulating body with the result that it advantageously extends along a diameter of the cylindrical insulating body which provides said shield connection element with a particularly large magnitude of stability.

It has proven to be particularly advantageous that the elastic deformation of the shield connection element occurs in this plane more specifically in the plane of its planar deformation section. This effect is considerably supported by the at least in part arrangement of the shield connection element in the planar slit.

Advantageously, the shield connection element with its contact regions may contact in an electrically conductive manner an electrically conductive plug connector installation housing, which corresponds to the insulating body, with a mechanical contact force, which is to be advantageously very precisely defined by the shape of the shield connection element, and in particular with an associated contour of the at least one contact region, said contour being very simply determinable in the stamping procedure and thus very simply adjustable, over a desired path length of the plug-in region, in other words over the desired tolerance region. It is by way of example desired to increase the particular path length over which the insulating body is inserted into the plug connector installation housing, thus it is advantageous to design the contour of the contact region somewhat flatter. As a consequence, the corresponding insertion forces and therefore the mechanical stresses that the printed circuit board are exposed to are reduced and the said tolerance region required for the device structure is increased.

If in contrast the pressing force of the at least one contact region against the plug connector installation housing is to be increased, by way of example by the electrical conductivity of the ground connection in particular in the high frequency range and/or the reliability of this connection is to be more reliably ensured, then the contour of the contact region may be configured overall to be higher and where appropriate also to be steeper. As further explained in detail below, the pressing force may be adjusted by suitably configuring the deformation section.

Advantageously, this structural shape therefore offers the person skilled in the art a multiplicity of simply adjustable and technically simply achievable parameters in order to adapt the shield connection with some few simple changes to meet the requirements of a specific plug connector. Furthermore, the tolerance region that is required for the device structure may be simply defined by way of this structural shape. A further advantage is that also over a long period of time in the assembled state the shield connection element does not irreversibly mechanically deform which would in the long term reduce the pressing force of the shield connection element with respect to the plug connector installation housing in a magnitude which is relevant for the conductivity of the ground connection. Finally, the plane of the planar shield connection element or at least of its planar deformation section is oriented in the effective direction of the corresponding contact force, which as required also renders possible very high contact forces, wherein the contact force may be furthermore also very simply adjusted by way of the stamped shape.

Consequently, as a result of this structural shape an irreversible deformation of the shield connection element is not expected or at least only a considerably smaller irreversible deformation is to be expected than is known from the prior art, in other words by way of example in the case of a contact tab that protrudes from a shield face and is for example stamped out of a sheet metal and bent out of the plane of the sheet metal. Simultaneously, the tolerance region that is required for the device structure may be considerably greater that by way of example in the case of a contact ring that is often used in the prior art and is stamped out of a sheet metal and whose annular plane is curved in a wave shape. In comparison to these known structural shapes, the shield connection element is oriented fully or at least with its planar deformation section in the plug-in direction. The contact force consequently acts in the direction of this plane against the plug connector installation housing and ensures a particularly high magnitude of electrical conductivity of the ground connection.

In particular, the shield connection element may be a so-called "stamped-bent part" that is stamped out preferably from a spring-elastic sheet metal. If required, the shield connection element may be bent in a desired shape at some sites that are not part of the said planar deformation section. However, said shield connection element may be configured fully in a planar manner with the result that—in other words—the planar deformation section extends over the entire shield connection element. By virtue of using the stamping-bending technology, the shield connection element may be manufactured in a particularly cost-effective manner. In the current case, the shield connection element may therefore also be a special shape of a stamped-bent part that, although stamped in particular from a planar sheet metal does not however necessarily need to be bent with the result that, to be precise, in one advantageous embodiment, in other words, may be a purely stamped part. This has the additional advantage of being cost-effective to manufacture.

It is particularly advantageous that the said mechanical contact force and the contour of the contact region may also be adjusted during the manufacturing process very comfortably via the shape, in particular the stamped shape, of the shield connection element. Usually, the strength and the elasticity of the sheet metal is already predetermined in advance or is at least the same for the entire shield connection element. However, it is possible by virtue of the stamped shape to define the contour of the shield connection element and in particular the shape of its contact region/contact regions. In addition, it is possible by virtue of the stamped shape to adjust the elasticity and consequently the contact force with which the contact regions are pressed against the plug connector installation housing, as already mentioned, very precisely and with only very low outlay.

The shield connection element may comprise for this purpose a particularly advantageous shape. By way of example, the shield connection element may comprise two spring arms. Each of these spring arms may comprise two ends, namely a first end and a second end respectively. One of the said contact sections may be formed on the first end of each spring arm respectively. In order to electrically contact the plug connector installation housing, each contact section has the said contact region with a corresponding contour, wherein the contact regions face away from one another, in other words they face outward. If, as already mentioned above, the pressing force of the at least one contact region against the plug connector installation housing changes, by way of example increases or reduces, then this may inter alia occur by virtue of a suitable configuration of the deformation section, in that by way of example the shape and/or orientation of the spring arms is/are modified accordingly.

On their second end, the spring arms may be formed on a ground contact region of the shield connection element. The ground contact region may furthermore have at least one ground pin. This may, in particular if the entire shield connection element is configured in a planar manner, face in the same or the opposite direction as the two contact regions. It goes without saying that the ground pin may also be oriented at a right angle or as required in any desired angle thereto and simultaneously lie in the plane of the complete planar shield connection element.

In another embodiment, the ground contact region and/or the ground pin may however also be bent—depending upon the requirement of the plug connector and the orientation of its insulating body on the printed circuit board—in another direction, for example at a right angle or at any other angle thereto, in other words face a direction which protrudes from the plane of the deformation section and thus does not lie in the common plane of the contact regions (deformation plane). In the assembled state, the ground pin may protrude with one end out of the insulating body by way of example so as to electrically contact a ground connection of a printed circuit board in the assembling direction, in other words in the assembled state in the direction of the printed circuit board. In particular, the printed circuit board plug connector may be soldered by way of this ground pin to a ground connection of the printed circuit board that is provided for this purpose.

During the final procedure of assembling the device, it is possible in this manner to insert multiple insulating bodies that are arranged on a printed circuit board at least in part in respectively an associated plug connector installation housing. The plug connector installation housings are generally installation housings that are installed in the through-going openings of a device housing wall of an electrical device. The printed circuit board is located inside the device housing. The plug connector installation housing is embodied at least in part from an electrically conductive material, in particular from a metal material. Ideally, the device housing is also electrically conductive, by way of example manufactured from a metal material, and by virtue of the installation of the plug connector installation housing electrically conductively connected thereto and in the final assembled state conductively connected to the ground of the printed circuit board.

During the procedure of inserting the insulating body that is arranged on the printed circuit board and in which, as already described in detail, in each case a shield connection element is arranged, the printed circuit board may therefore also be electrically conductively connected via the shield connection elements to the device housing by way of a defined mechanical contact force and under correspondingly mechanical stresses that may be accordingly simply controlled and thus moved into an electrical ground connection.

In this case, the insulating body may be arranged both upright and also angled on the printed circuit board. If said insulating bodies are arranged in a upright manner, then their plug-in direction faces in a perpendicular manner away from the printed circuit board plane and they may be advantageously arranged in a two-dimensional manner in an entire array which increases their possible number. If on the other hand the insulating bodies are configured at an angle, then they are advantageously arranged on an edge of the printed circuit board in order to be plugged jointly into the associated plug connector installation housing by virtue of a corresponding movement of the printed circuit board.

A possible procedure of assembling a printed circuit board plug connector that comprises such a shield connection element is described by way of example below. By way of example, the insulating body of the printed circuit board plug connector may be configured in two parts. Said insulating body may then comprise a preferably cylindrical plug-in region and a contact carrier.

It has proven to be advantageous for the assembling procedure to orient the printed circuit board connection side of the contact carrier upward, in other words in the opposite direction to the force of gravity with the result that the shield connection element may slide into the contact carrier with the support of the force of gravity. A stop is located in the slit and said stop ensures that the shield connection element may not slip through the insulating body.

The contact carrier is now inserted together with the shield connection element in the plug-in direction into a cylindrical cut-out of the base body. The milling arrangement on the shield connection element renders it possible for said shield connection element to center itself during the insertion procedure and to independently achieve the final installation position. In the case of this installation position, the two spring arms of the shield connection element are inserted with the contact sections into the through-going slit of the plug-in region, in that they move toward one another as a result of the deformation. After the insertion procedure, said spring arms return to their relaxed state and then protrude, as already described, with their contact regions in a radial manner out of the plug-in region of the insulating body in order to mechanically and electrically contact the plug connector installation housing.

In a final step, the plug connector installation housing may now be pushed on the plug-in side onto the insulating body—or in other words, the insulating body is inserted with its plug-in region into the plug connector installation housing. In this case, the spring arms of the shield connection element deflect outward with respect to one another and contact the plug connector installation housing with the corresponding contact force.

The shield connection element may have a ground contact pin that protrudes out of the printed circuit board connection region of the contact carrier so as to connect to the ground contact of the printed circuit board. The contact arrangement with this ground contact may be provided by way of example by way of a soldering method such as surface mounting technology or through hole technology but also by way of press-in technology.

BRIEF DESCRIPTION OF THE SEVERAL VIEWS OF THE DRAWINGS

An exemplary embodiment of the invention is illustrated in the drawings and is explained in detail below. In the drawings.

The figures illustrate in part simplified schematic views. In part, identical reference numerals are used for similar but possibly not identical elements. Different views of similar elements may be scaled differently.

DETAILED DESCRIPTION

Figure 1A:
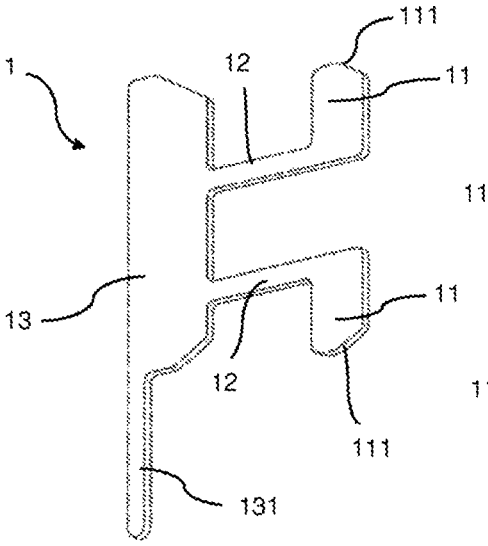
FIGS. 1*a* and 1*b* illustrate a planar shield connection element from different angles of view.
Figure 1B:
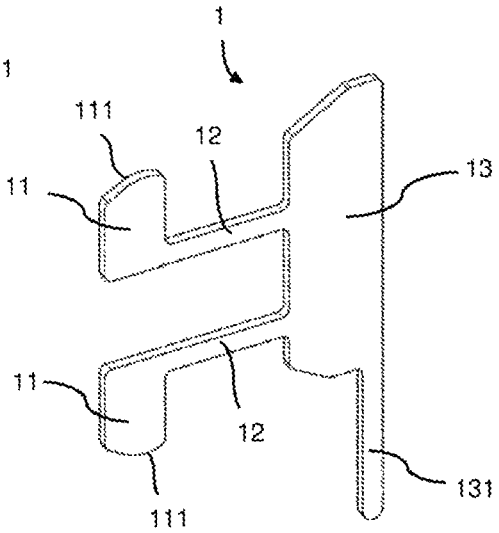
Figure 3A:
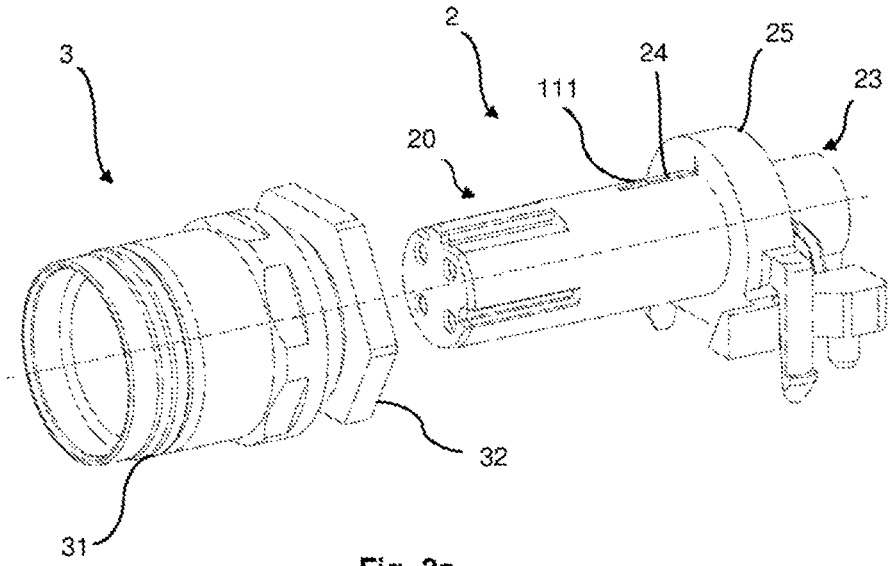
FIG. 3*a* illustrates an oblique view of the insulating body with the shield connection element and a plug connector installation housing.

FIGS. 1*a* and 1*b* illustrate a shield connection element 1 from two different views. The shield connection element 1 has two contact sections 11 that are connected via in each case a spring arm 12 to a ground contact region 13. The two contact sections 11 have in each case a contact region 111 for mechanically and electrically contacting a plug connector installation housing 3 that is illustrated in FIG. 3*a*. The two contact regions 111 are facing away from one another, in other words oriented with their contact regions 111 facing outword.

In the illustrated embodiment, the shield connection element 1 is configured fully in a planar manner, in other words it lies fully in a single plane. It goes without saying that its deformation section is also configured in a planar manner. In this embodiment, the deformation section is formed by way of the two spring arms 12 with the contact sections 11, which are formed thereon, with the associated contact regions 111. In this embodiment, the shield connection element 1 is stamped out of a spring-elastic sheet metal. Since it is not bent, it is also referred to as a stamped part.

The contact regions 111 that are oriented outward have in each case a defined contour. As will be described below, the embodiment of the contour of the contact regions 111 and the shape, in particular the length and width and also the orientation of the spring arms 12 render it possible to very precisely adapt the special elastic characteristics of the deformation section of the shield connection element 1.

Figure 1C:
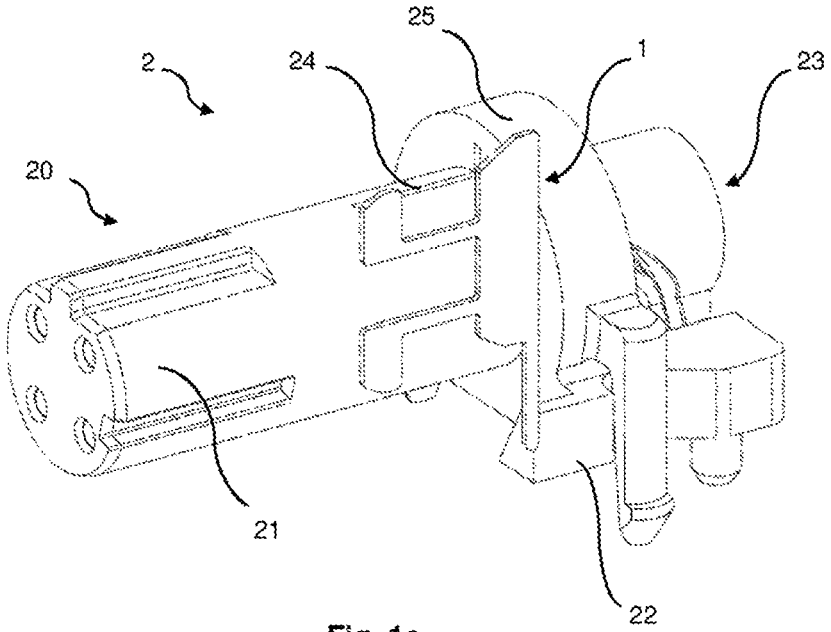
FIG. 1*c* illustrates an angled insulating body with the shield connection element to be inserted therein.

FIG. 1*c* illustrates an angled insulating body 2 of a printed circuit board plug connector with the shield connection element 1 that is to be inserted therein. The insulating body 2 has a base body 20 with an essentially cylindrical plug-in region 21. Furthermore, the insulating body 2 has a printed circuit board connection region 22.

Figure 4A:
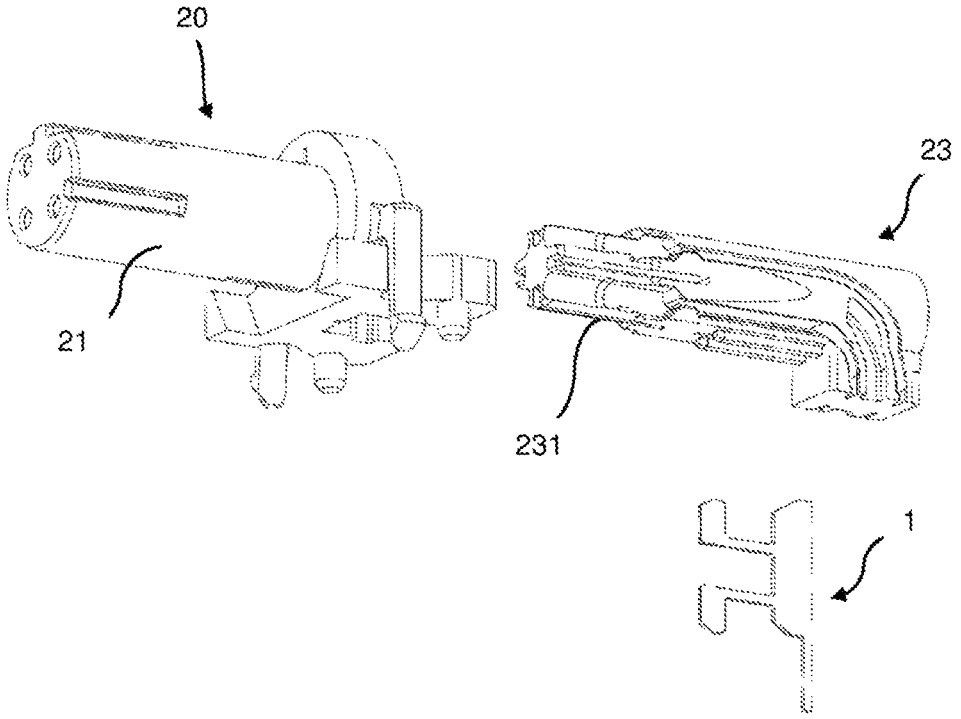
FIGS. 4*a*-4*c* illustrate the insulating body with separated base body and contact carrier for inserting the shield connection element.
Figure 4B:
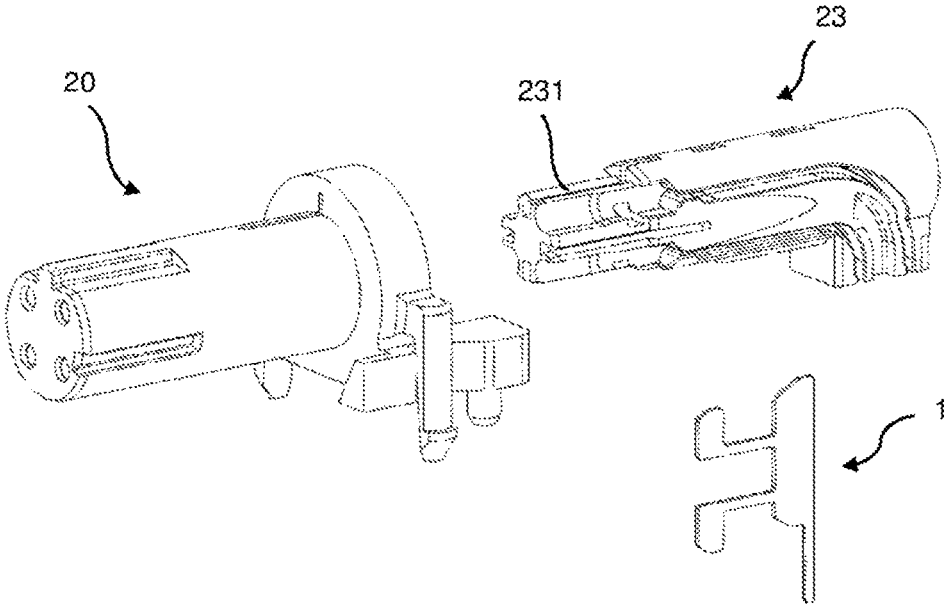
Figure 4C:
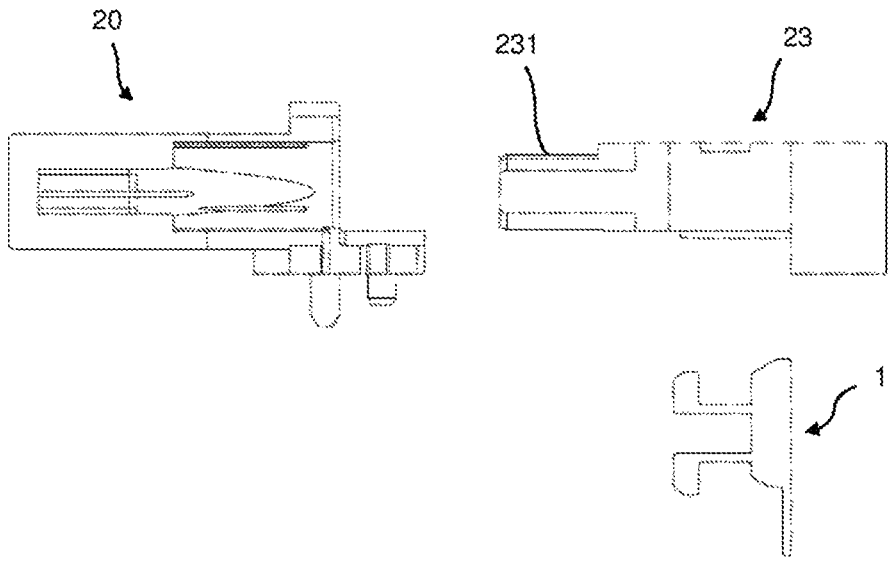
Figure 4D:
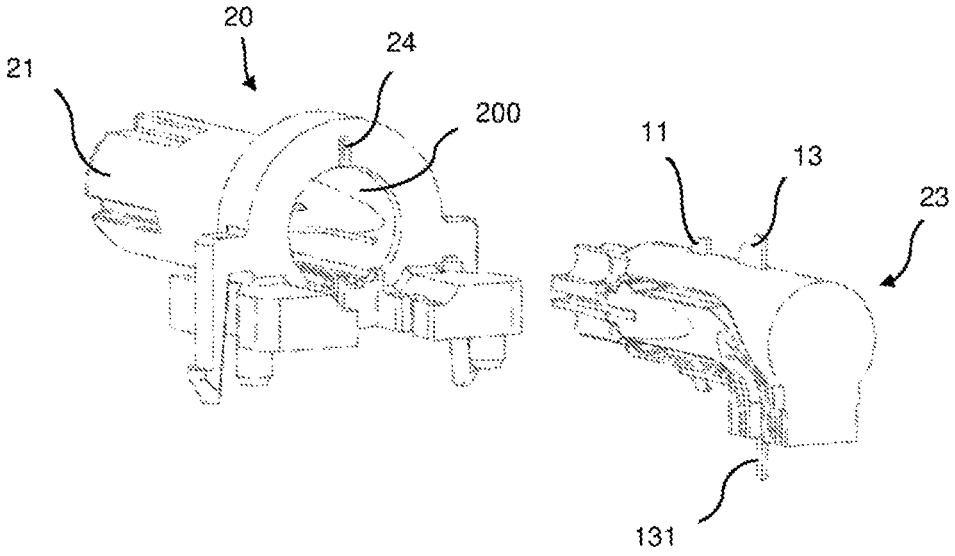
FIG. 4*d* illustrates the contact carrier with the shield connection element inserted therein and the base body.

The insulating body 2 is configured in two parts and has in addition to this base body 20 a separate contact carrier 23 that is particularly clear to see as an individual part in FIGS. 4*a*-4*c*. The contact carrier 23 likewise has an essentially cylindrical plug section 231 with which it is pushed into an essentially cylindrical cut-out 200 of the base body 20. The insulating body 2 has furthermore a through-going slit 24 that has a planar progression.

One region of the through-going slit 24 is arranged in the plug-in region 21 of the base body 20 and is guided in a radial manner through this cylindrical plug-in region 21. A further region of the through-going slit 24 extends through the contact carrier 23. The through-going slit 24 is configured in a planar manner and is provided so as to receive the planar shield connection element 1.

In the assembled state, if in other words the plug-in section 231 (FIGS. 4*a* and 4*b*) of the contact carrier 23 is received as illustrated in the base body 20, the through-going slit 24 extends in a radial manner through the plug-in region 21 and the plug-in section 231. Consequently, the shield connection element 1 that is inserted therein engages through the insulating body 2 at its plug-in region 21.

Figure 2A:
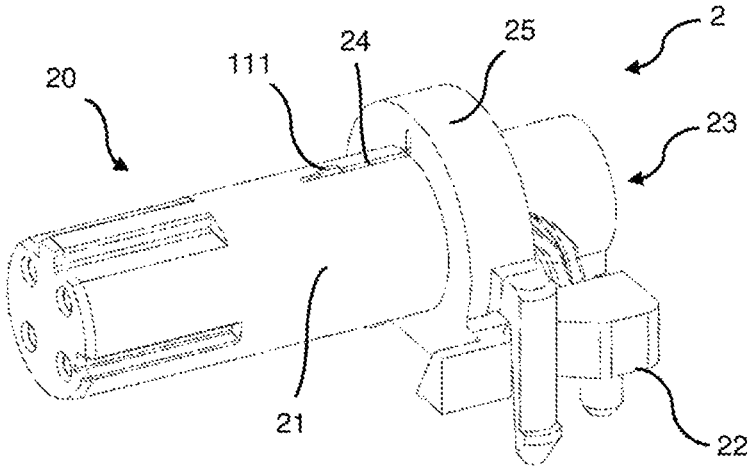
FIGS. 2*a* and 2*b* illustrate the angled insulating body with the shield connection element inserted therein from two different views.
Figure 2B:
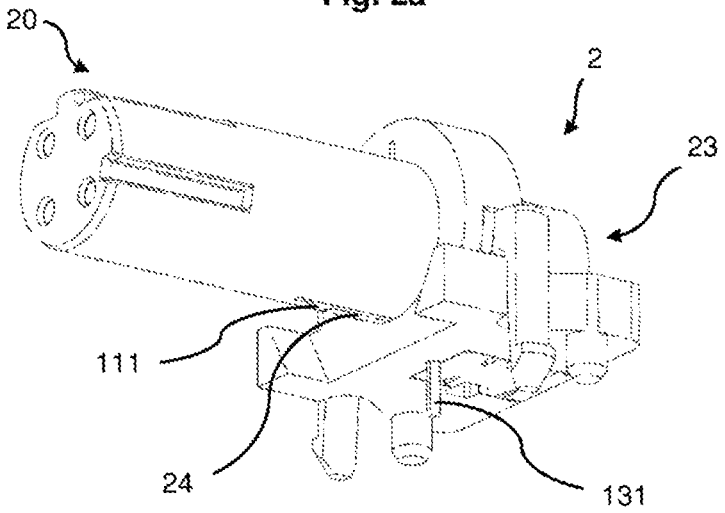
Figure 2C:
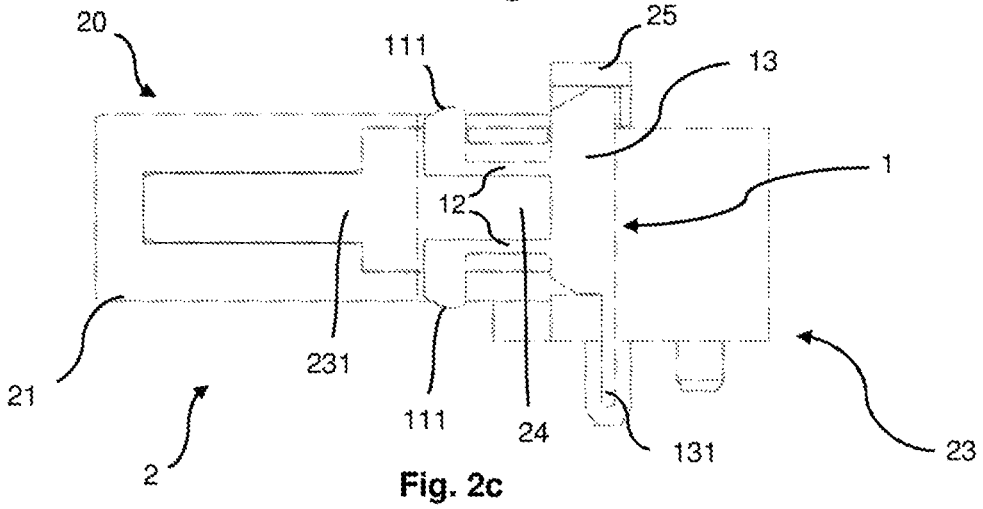
FIG. 2*c* illustrates a cross-sectional view of the angled insulating body with the shield connection element inserted therein.

The insulating body 2 has between the plug-in region 21 and the printed circuit connection region 22 a cylindrical holding section 25 that is part of the base body 20 and whose diameter is considerably greater than the diameter of the plug-in region 21. A region of the through-going slit 24 is likewise arranged in the holding section 25. This region of the through-going slit 24 is used so as to receive the said ground contact region 13 of the shield connection element 1. The ground contact region 13 of the shield connection element 1 is then arranged in the holding section 25. The width of the through-going slit 24 corresponds to the thickness of the shield connection element 1. As a consequence, the shield connection element 1 is held in a positive-locking manner in the insulating body 2 at least in a perpendicular manner with respect to the slit plane FIGS. 2*a*, 2*b* and 2*c* illustrate the insulating body 2 with the shield connection element 1 inserted in its through-going slit 24 from two different views and also in a cross-sectional view. The two contact sections 11 protrude with their contact regions 111 on both sides of the plug-in region 21 out of the through-going slit 24 and thus protrude out of the insulating body 2.

It is apparent from FIG. 2*c* that the through-going slit 24 is guided between the spring arms 12 of the inserted shield connection element 1 through the plug-in section 231 of the contact carrier 23 with the result that the two spring arms 12 may move toward one another in an elastically deforming manner. The ground contact region 13 of the shield connection element 1 is arranged in the contact carrier 23 of the insulating body 2 and protrudes with its ground contact pin 131 out of an opening that is provided for this purpose in the printed circuit connection region 22 in order to contact a ground contact of a printed circuit board.

FIG. 3*a* illustrates the insulating body 2 from the preceding illustration with a metal plug connector installation housing 3. The plug connector installation housing 3 has a housing plug-in region 31 for mating with a mating connector and also a screw nut 32 for attaching and electrically connecting the plug connector installation housing 3 to a device housing of an electrical device (not illustrated). The plug connector installation housing 3 extends in a slightly tapering conical manner toward its plug-in region 31.

It is easily apparent that by virtue of inserting the insulating body 2 into the plug connector installation housing 3 the contact regions 111 of the contact sections 11 that protrude in a radial manner out of the insulating body 2 come into electrical contact with the metal plug connector installation housing 3.

By virtue of inserting the plug-in region 21 of the insulating body 2 further inward, the contact sections 11 may be moved toward one another in an elastic manner in accordance with the contour of their contact regions 111. As a consequence, the shield connection element 1 generates the pressing force that is required to secure the electrical contact arrangement.

Figure 3B:
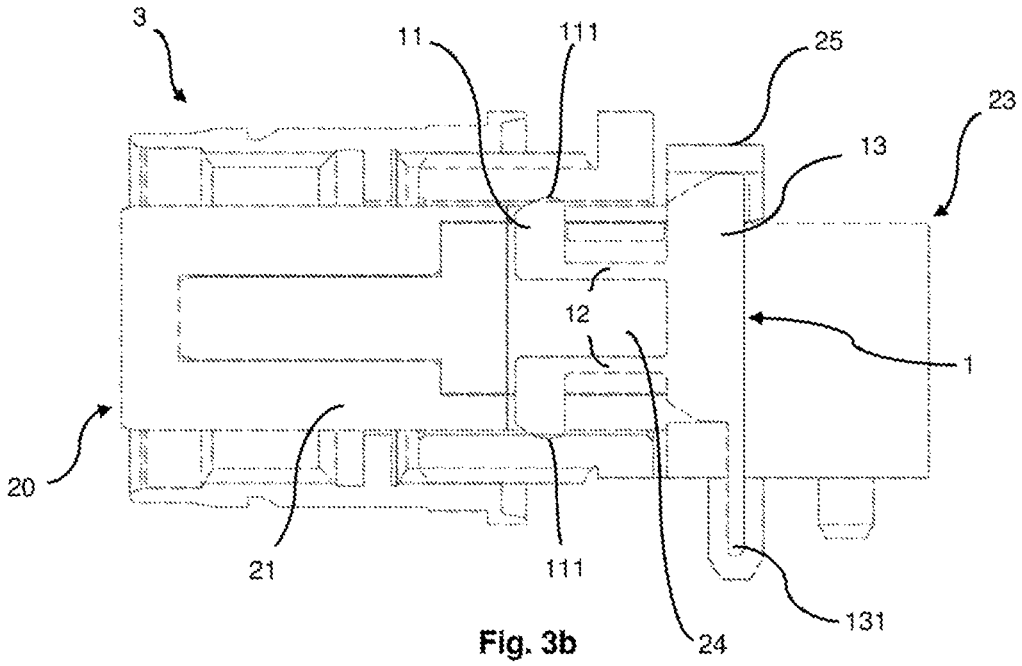
FIG. 3*b* illustrates a cross-sectional view of the insulating body with the shield connection element and the plug connector installation housing.

FIG. 3*b* illustrates the insulating body 2 with the inserted shield connection element 1 and plug connector installation housing 3 in a cross-sectional view, wherein the insulating body 2 is finally inserted with its plug-in region 21 into the plug connector installation housing 3. The shield connection element 1 engages through the insulating body 2 in a radial manner and contacts the plug connector installation housing 3 on both sides with its contact regions 111. The mechanical and electrical contact is illustrated at this site by way of a slight overlapping arrangement. It is easily feasible that the two spring arms 12 move toward one another in an elastic manner in the through-going planar slit 24 during the procedure of inserting the insulating body 2 into the plug connector installation housing 3 and generate a pressing force/contact force with respect to the plug connector installation housing 3. This contact force is dependent upon the spring constants of the two spring arms 12 and upon the extent of their deflection. The deflection is in turn dependent upon the shape of the contact regions 111. In particular, the force during the insertion procedure is also determined by its shape. The spring force of the two spring arms 12 is determined by their shape, in particular by their length and/or width. Since the shield connection element 1 is stamped out of a sheet metal, these parameters may be adjusted during the manufacturing process in a very simple manner by virtue of configuring the stamped shape in a precise manner.

Broadly speaking, the planar shield connection element 1 that is inserted into the insulating body 2 lies in a deformation plane that corresponds to the slit plane. In this case, the shield connection element 1 is able to generate a mechanical contact force that is required for electrically contacting the plug connector installation housing 3 and is in the form of a counter force to an elastic deformation, wherein this deformation occurs exclusively in the deformation plane. The slit plane and the deformation plane are oriented parallel to the plug-in axis of the printed circuit board plug connector. As a consequence, the shield connection element 1 may not tilt against it during the procedure of inserting said shield connection element into the plug connector installation housing 3 with its contact sections 11.

In the printed circuit board connection region, the through-going slit 24 of the insulating body 2 has a further exit opening through which the ground contact pin 131 is guided so as to electrically contact the ground connection (not illustrated) of the printed circuit board (not illustrated). Consequently, the plug connector installation housing 3 may be grounded via the shield connection element 1 at the printed circuit board.

The procedure of assembling the plug connection is illustrated in FIGS. 4*a*-4*e*.

Figure 4E:
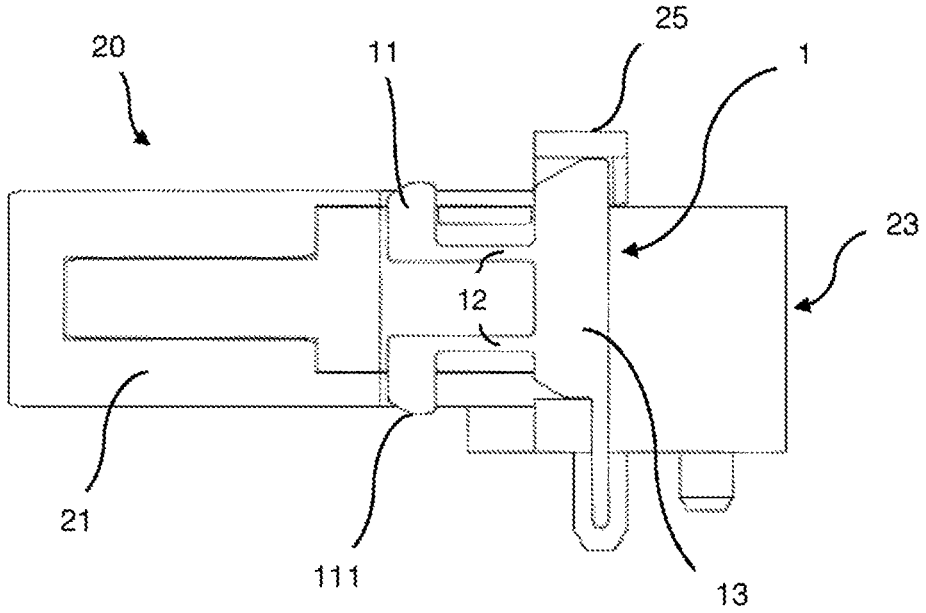
FIG. 4*e* illustrates a cross-sectional view of the base body with the inserted contact carrier with the shield connection element inserted therein.

FIGS. 4*a*, 4*b* and 4*c* illustrate the base body 20, the contact carrier 23 and the shield connection element 1 as separate components. During the assembly procedure, the shield connection element 1 is initially plugged into the contact carrier 23. The contact carrier 23 is then inserted together with the shield connection element 1 with its plug-in section 231 into a cylindrical cut-out 200 of the base body 20 that is clearly visible in FIG. 4*d*. During the insertion procedure, the deformation section of the shield connection element 1 deforms accordingly in order to render it possible to insert the contact carrier 23 into the base body 20. In the inserted state, the contact sections 11 protrude with their contact regions 111 on both sides out of the plug-in region 21 of the insulating body 2, as is illustrated in FIG. 4*e*, in order to mechanically and electrically contact the plug connector housing 3, as is illustrated in FIG. 3*b*.

In general, in the following claims, the terms used should not be construed to limit the claims to the specific embodiments disclosed in the specification and the claims, but should be construed to include all possible embodiments along with the full scope of equivalents to which such claims are entitled.

The invention claimed is:

1. A printed circuit board plug connector comprising:

a shield connection element, which comprises at least one planar deformation section including spring arms and opposing planar contact sections that lie in a common plane of the deformation section, each of the opposing planar contact sections having a respective contact edge that is oriented perpendicular to the common plane;

a plug connector installation housing, which is embodied at least in part from metal; and an insulating body, which comprises a through-going slit into which the shield connection element is inserted, wherein the insulating body is arranged with a plug-in region thereof in the plug connector installation housing, and wherein, in order for the plug connector installation housing to electrically contact a ground connection of a printed circuit board, the shield connection element electrically contacts with the contact edges of the opposing planar contact sections, which protrude on opposing sides radially out of the insulating body, the plug connector installation housing from inside at least at two sites that lie opposite one another.

2. The printed circuit board plug connector as claimed in claim 1, wherein the shield connection element is able to generate a mechanical contact force that is required for electrically contacting the plug connector installation housing via an elastic deformation that occurs in the common plane of the deformation section defined by the planar deformation section.

3. The printed circuit board plug connector as claimed in claim 1, wherein the shield connection element is configured as one piece.

4. The printed circuit board plug connector as claimed in claim 1, wherein the shield connection element is formed from a spring-elastic sheet metal.

5. The printed circuit board plug connector as claimed in claim 1, wherein the shield connection element is a stamped part.

6. The printed circuit board plug connector as claimed in claim 1, wherein the deformation section has two spring arms, wherein in each case a contact section is formed with in each case a contact region on the spring arms, and wherein the contact regions of the contact sections face away from one another.

7. The printed circuit board plug connector as claimed in claim 1, wherein the shield connection element has a ground contact region on which the at least one planar deformation section is formed.

8. The printed circuit board plug connector as claimed in claim 7, wherein the ground contact region comprises a ground contact pin for contacting the ground connection of the printed circuit board.

9. The printed circuit board plug connector as claimed in claim 1, wherein the complete shield connection element is configured in a planar manner.

10. The printed circuit board plug connector as claimed in claim 1, wherein the shield connection element is inserted into the through-going slit of the insulating body and engages with the at least one planar deformation section in a radial manner through the insulating body.

11. The printed circuit board plug connector as claimed in claim 1, wherein the insulating body is configured at least in two parts so as to facilitate the insertion of the shield connection element and thus has at least two parts, namely a base body and a contact carrier, wherein the base body comprises an essentially cylindrical cut-out and wherein the contact carrier is insertable at least in part into the cylindrical cut-out of the base body.

12. The printed circuit board plug connector as claimed in claim 11, wherein a region of the through-going slit is arranged in the plug-in region of the base body of the insulating body, and wherein a further region of the through-going slit is arranged in the contact carrier.

13. The printed circuit board plug connector as claimed in claim 7, wherein the insulating body comprises at a printed circuit board connection region an outlet for electrically contacting the ground connection of the printed circuit board via the ground contact pin of the shield connection element.

* * * * *